US009863120B2

(12) United States Patent
O'Neill et al.

(10) Patent No.: US 9,863,120 B2
(45) Date of Patent: Jan. 9, 2018

(54) SYSTEM AND METHOD FOR CONTROLLING A MACHINE IMPLEMENT

(71) Applicant: Caterpillar Inc., Peoria, IL (US)

(72) Inventors: William N. O'Neill, Eureka, IL (US); Lance M. Cowper, Metamora, IL (US); Michael T. Jackson, Hanna City, IL (US)

(73) Assignee: Caterpillar Inc., Peoria, IL (US)

( * ) Notice: Subject to any disclaimer, the term of this patent is extended or adjusted under 35 U.S.C. 154(b) by 245 days.

(21) Appl. No.: 14/699,024

(22) Filed: Apr. 29, 2015

(65) Prior Publication Data

US 2016/0319512 A1 Nov. 3, 2016

(51) Int. Cl.

| | |
|---|---|
| ***E02F 3/84*** | (2006.01) |
| ***E02F 3/76*** | (2006.01) |
| ***E02F 9/22*** | (2006.01) |

(52) U.S. Cl.

CPC ..... *E02F 3/844* (2013.01); *E02F 3/7618* (2013.01); *E02F 9/2203* (2013.01)

(58) Field of Classification Search

CPC ..... E02F 3/844; E02F 3/7618; E02F 9/2203; E02F 9/2029; E02F 9/2221

See application file for complete search history.

(56) References Cited

U.S. PATENT DOCUMENTS 2,543,989 A * 3/1951 Rockwell ..... E02F 3/844 172/812
3,196,755 A * 7/1965 Chichester ..... B66F 9/22 91/420
3,631,930 A * 1/1972 Peterson ..... E02F 3/7618 172/821
3,638,818 A * 2/1972 King ..... E02F 9/2203 414/699
3,661,215 A 5/1972 Pensa
3,774,696 A * 11/1973 Horsch ..... E02F 3/844 172/812
4,158,393 A 6/1979 Kimber et al.
4,166,506 A 9/1979 Tezuka et al.
4,201,268 A * 5/1980 Frisbee ..... E02F 3/844 172/812
4,270,617 A * 6/1981 Cantarella ..... E02F 3/7613 172/701.1
4,367,624 A * 1/1983 Ogata ..... E02F 3/844 60/484

(Continued)

*Primary Examiner* — Robert E Pezzuto
*Assistant Examiner* — Adam J Behrens

(57) ABSTRACT

A control system for a work implement of a machine having a frame is provided. The control system includes a pair of lift cylinders operatively coupled to the work implement and configured to raise or lower the work implement with respect to the frame. Each of the lift cylinders has a rod end and a cap end. The control system includes a first cross-over line configured to fluidly communicate the rod ends to each other and a second cross-over line configured to fluidly communicate the cap ends to each other. The control system includes a cross-over valve disposed in one of the first and second cross-over lines and configured to regulate a flow of hydraulic fluid therethrough. The control system further includes a controller communicably coupled to the cross-over valve and configured to at least partially close the cross-over valve during a dump cycle of the work implement.

20 Claims, 4 Drawing Sheets

(56) References Cited

U.S. PATENT DOCUMENTS

| | | | | | |
|---|---|---|---|---|---|
| 4,505,339 | A | | 3/1985 | Kramer et al. | |
| 5,473,828 | A | * | 12/1995 | Kishi | B66C 3/16 294/68.23 |
| 5,682,955 | A | * | 11/1997 | Groth | E02F 3/844 172/811 |
| 5,769,168 | A | * | 6/1998 | Skiba | E02F 3/845 172/4.5 |
| 5,996,703 | A | * | 12/1999 | Yamamoto | E02F 3/845 172/4.5 |
| 7,827,787 | B2 | * | 11/2010 | Cherney | E02F 9/2203 60/414 |
| 8,340,875 | B1 | | 12/2012 | Shatters et al. | |
| 2003/0121410 | A1 | * | 7/2003 | Smith | E02F 3/844 92/28 |
| 2009/0165450 | A1 | * | 7/2009 | Cherney | E02F 9/2203 60/413 |
| 2009/0223688 | A1 | * | 9/2009 | Hendron | E02F 3/7613 172/821 |
| 2010/0275771 | A1 | * | 11/2010 | Helbling | E02F 9/2203 91/528 |
| 2010/0303643 | A1 | | 12/2010 | Kataoka et al. | |
| 2011/0060504 | A1 | * | 3/2011 | Filla | B60W 10/06 701/41 |
| 2012/0321425 | A1 | * | 12/2012 | Shatters | E02F 3/432 414/700 |
| 2014/0345889 | A1 | * | 11/2014 | Nakata | E02F 3/7613 172/1 |
| 2015/0308078 | A1 | * | 10/2015 | Lee | E02F 9/2025 701/50 |
| 2015/0330057 | A1 | * | 11/2015 | Faivre | E02F 3/7618 701/50 |
| 2016/0238041 | A1 | * | 8/2016 | Kajita | E02F 9/2217 |
| 2016/0244940 | A1 | * | 8/2016 | Shimada | E02F 5/32 |

* cited by examiner

SYSTEM AND METHOD FOR CONTROLLING A MACHINE IMPLEMENT

TECHNICAL FIELD

The current disclosure relates to an implement of a machine, and more particularly to a system and a method for controlling a machine implement.

BACKGROUND

Machines such as dozers are used to perform various operations such as, digging, dumping or levelling a surface of the ground. Such machines may typically employ an implement such as a blade to perform one or more of these operations. An operator may provide one or more inputs indicative of a desired position or movement of the implement. The implement may be tilted and/or rotated using one or more actuators, for example a pair of tilt cylinders based on the input.

However, during some operations, the implement may tilt excessively than the required tilting movement. In an example, the excess tilting may be due to uneven load on the implement during dumping. Moreover, such a tilting movement may create a perception to the operator indicating improper control of the implement. In such cases, the operator may not be able to set a desired position for the implement. In some conventional control systems, undesirable tilting movement is controlled by regulating fluid communication between the tilt cylinders.

For reference, U.S. Pat. No. 3,196,755 relates to a flow control system for a load-handling apparatus having a plurality of piston and cylinder units. The pistons of the cylinder units are actuated away from one set of ends of the cylinders with load assistance and actuated away from the opposite set of ends of the cylinders against load resistance. The flow control system includes a means for connecting either set of ends of the cylinders with a source of fluid under pressure and for exhausting fluid from either set of ends of the cylinders in correlated in-one-end-out-the-other end manner. The means includes a single valve and a valve seat. The means further biases the valve into fluid sealing relation with the valve seat. The valve in the sealing relation blocks the exhaust from the other set of ends and becomes responsive to the pressure in the one set of ends to allow the exhaust of fluid from the other set of ends only after build up of a predetermined pressure in the one set of ends to prevent cavitation in the one set of ends.

SUMMARY OF THE DISCLOSURE

In one aspect of the current disclosure, a control system for a work implement of a machine having a frame is provided. The control system includes a pair of lift cylinders operatively coupled to the work implement and configured to raise or lower the work implement with respect to the frame of the machine. Each of the pair of lift cylinders has a rod end and a cap end. The control system includes a first cross-over line configured to fluidly communicate the rod end of each of the pair of lift cylinders to each other. The control system also includes a second cross-over line configured to fluidly communicate the cap end of each of the pair of lift cylinders to each other. The control system includes a cross-over valve that is disposed in one of the first cross-over line and the second cross-over line and configured to regulate a flow of hydraulic fluid therethrough. The control system further includes a controller communicably coupled to the cross-over valve. The controller is configured to at least partially close the cross-over valve during a dump cycle of the work implement.

In another aspect of the current disclosure, a method of controlling a work implement of a machine is provided. The machine has a pair of lift cylinders operatively coupled to the work implement and configured to raise or lower the work implement with respect to a frame of the machine. The method includes fluidly communicating a rod end of each of the pair of lift cylinders to each other via a first cross-over line. The method also includes fluidly communicating a cap end of each of the pair of lift cylinders to each other via a second cross-over line. The second cross-over line includes a cross-over valve movable between an open position and a closed position. The method further includes actuating the cross-over valve to at least a partially closed position during a dump cycle of the work implement to at least partially block flow from communicating between the cap ends of the pair of lift cylinders.

In yet another aspect of the current disclosure, a machine is provided. The machine includes a frame defining a longitudinal axis and a transverse axis substantially perpendicular to the longitudinal axis. The machine also includes a work implement movably coupled to the frame. The machine also includes a pair of lift cylinders operatively coupled to the work implement and configured to raise or lower the work implement with respect to the frame of the machine. Each of the pair of lift cylinders has a rod end and a cap end. The machine also includes a pair of tilt cylinders operatively coupled to the work implement and configured to rotate the work implement about the longitudinal axis and the transverse axis of the frame of the machine. The machine includes a first cross-over line configured to fluidly communicate to one of the rod end and the cap end of each of the pair of lift cylinders to each other. The machine also includes a second cross-over line configured to fluidly communicate to the other of the rod end and the cap end of each of the pair of lift cylinders to each other. The machine includes a cross-over valve that is disposed in the second cross-over line and configured to regulate a flow of hydraulic fluid therethrough. The machine further includes a controller communicably coupled to the cross-over valve. The controller is configured to at least partially close the cross-over valve during a dump cycle of the work implement.

Other features and aspects of this disclosure will be apparent from the following description and the accompanying drawings.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts.

Figure 1:
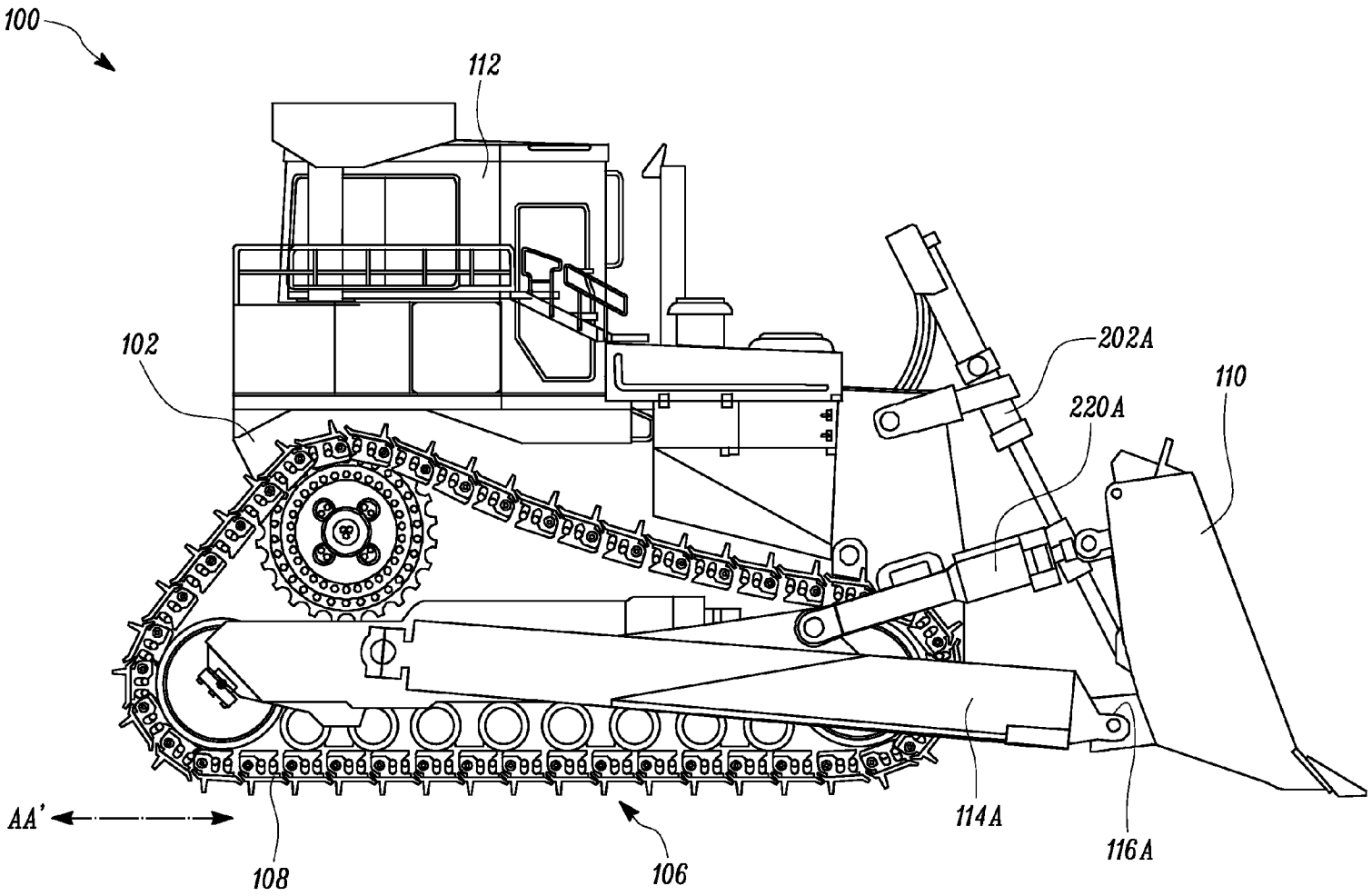
FIG. 1 is a side view of a machine showing a work implement, according to an exemplary embodiment of the current disclosure.

FIG. 1 illustrates a side view of a machine 100, according to an exemplary embodiment of the current disclosure. In the illustrated embodiment, the machine 100 is a dozer. The machine 100 may be a fixed or a mobile machine that is configured to perform some type of operation associated with an industry such as mining, construction, farming, transportation, or any other industry known in the art. For example, the machine 100 may be an excavator, a harvester, a backhoe or other machines known in the art.

The machine 100 includes a frame 102 defining a longitudinal axis AA' and a transverse axis BB' (shown in FIG. 2) that is substantially perpendicular to the longitudinal axis AA'. The machine 100 also includes a set of ground engaging members 108 supported on the frame 102. In the illustrated embodiment, the machine 100 includes an undercarriage 106 supported on the frame 102 of the machine 100. The undercarriage 106 includes the set of ground engaging members 108 embodied as a track assembly in FIG. 1. The track assembly may be configured to rotate thereby propelling the machine 100. Alternatively, the set of ground engaging members 108 may be a plurality of wheels configured to propel the machine 100.

The machine 100 further includes a work implement 110 configured to perform various tasks at a worksite. The work implement 110 may be configured to engage, penetrate, or cut the surface of the worksite and/or may be further configured to move the earth to accomplish a predetermined task. The worksite may include, for example, a mine site, a landfill, a quarry, a construction site, or any other type of worksite. Moving the earth may be associated with altering the geography at the worksite and may include, for example, a grading operation, a scraping operation, a leveling operation, a bulk material removal operation, or any other type of geography altering operation at the worksite.

In the illustrated embodiment, the work implement 110 is a blade that may be movably mounted to the frame 102. The work implement 110 may be disposed on the frame 102 at a front end of the machine 100. The work implement 110 may be configured to perform digging operation to dig material from the work site and also hold the material therein. During holding the material, the work implement 110 may also be moved along the longitudinal axis AA' to reach a location for dumping the material. Additionally, during the dump cycle, the work implement 110 may also be raised to reach the location for dumping the material. Further, the work implement 110 may also be configured to rotate about the transverse axis BB' upon reaching the location thereby dumping the material.

In one embodiment, a dump cycle for the work implement 110 may be defined as a cycle in which the work implement 110 performs the dumping operation. As such, the work implement 110 may be configured to rotate about the transverse axis BB' during the dump cycle. In another embodiment, the dump cycle for the work implement 110 may be defined as a cycle in which the work implement 110 performs the holding and dumping operation. Accordingly, during the dump cycle, the work implement 110 may move to reach the dumping location and also rotate about the transverse axis BB' of the frame 102. In one example, during the dump cycle, the work implement 110 may be moved along the longitudinal axis AA' and/or raised to reach the dumping location and subsequently rotated about the transverse axis BB'. In another example, during the dump cycle, the work implement 110 may be raised and simultaneously rotated about the transverse axis BB' to perform the dumping operation.

In various other embodiments, the work implement 110 may include any device used in the performance of a task. For example, the work implement 110 may include a blade, a bucket, a shovel, a hammer, an auger, a ripper, or any other task-performing device known in the art. Further, the work implement 110 may be configured to pivot, rotate, slide, swing, or move relative to the frame 102 of the machine 100 in any other manner known in the art.

The machine 100 may further include an operator station or cab 112 containing controls or input devices for operating the machine 100. The cab 112 may also include one or more input devices (not shown) for propelling the machine 100, controlling the work implement 110 and/or other machine components. In an example, the one or more input devices may include one or more joysticks, levers, switches and pedals disposed within the cab 112 and may be adapted to receive input from an operator indicative of a desired movement of the work implement 110 and the set of ground engaging members 108. In the illustrated embodiment, the cab 112 may include an input device (not shown) such as, a joystick, or a control button operable to generate commands for the work implement 110 to implement one or more operations of the dump cycle.

The machine 100 may further include a power source (not shown) to supply power to various components including, but not limited to, the set of ground engaging members 108, and the work implement 110. In an example, the power source may be an engine. The engine may embody, for example, a diesel engine, a gasoline engine, a gaseous fuel-powered engine, or any other type of combustion engine known in the art. It is contemplated that the power source may alternatively embody a non-combustion source of power (not shown) such as, for example, a fuel cell, a power storage device, or another suitable source of power.

Figure 2:
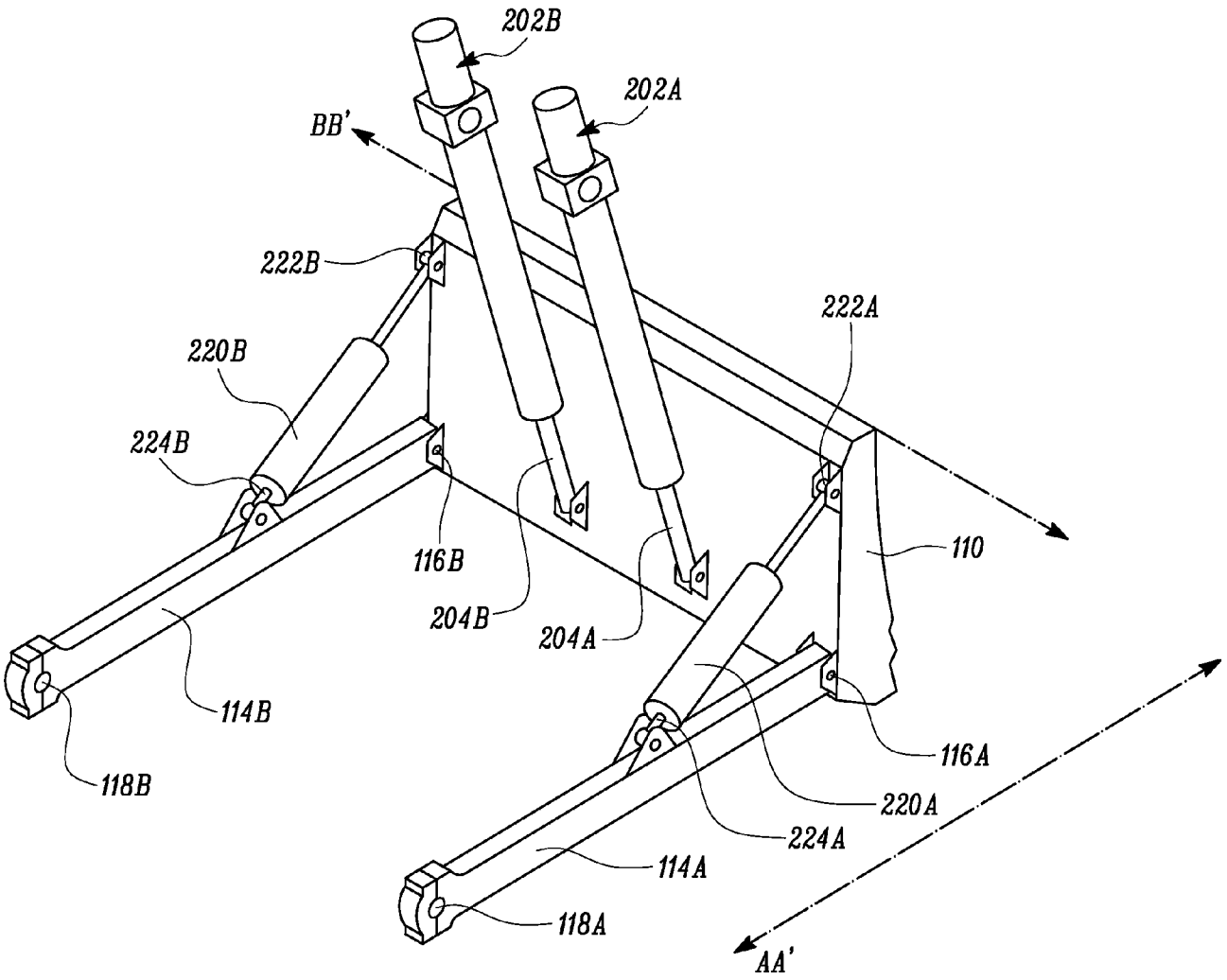
FIG. 2 is a partial perspective view of the machine showing a control system for the work implement, according to an embodiment of the current disclosure.

Referring to FIGS. 1 and 2, the machine 100 may include a pair of push arms 114A, 114B (also collectively referred to as "the push arms 114") spaced apart from each other. First ends 116A, 116B of the push arms 114A, 114B respectively, may be pivotally coupled to the work implement 110. As shown in FIG. 1, second ends 118A, 118B of the push arms 114A, 114B may be pivotally coupled to the undercarriage 106. Alternatively, the second ends 118A, 118B may be coupled to the frame 102. In an example, the push arms 114 may be connected to the work implement 110 and the frame 102 in a conventional manner, such as by a pivot shaft that pivotally connects the work implement 110 to the frame 102. The push arms 114 may have a substantially same length and are configured to hold the work implement 110 at the front end of the machine 100. Further, the push arms 114 may be configured to move the work implement 110 along the longitudinal axis AA'.

Figure 3:
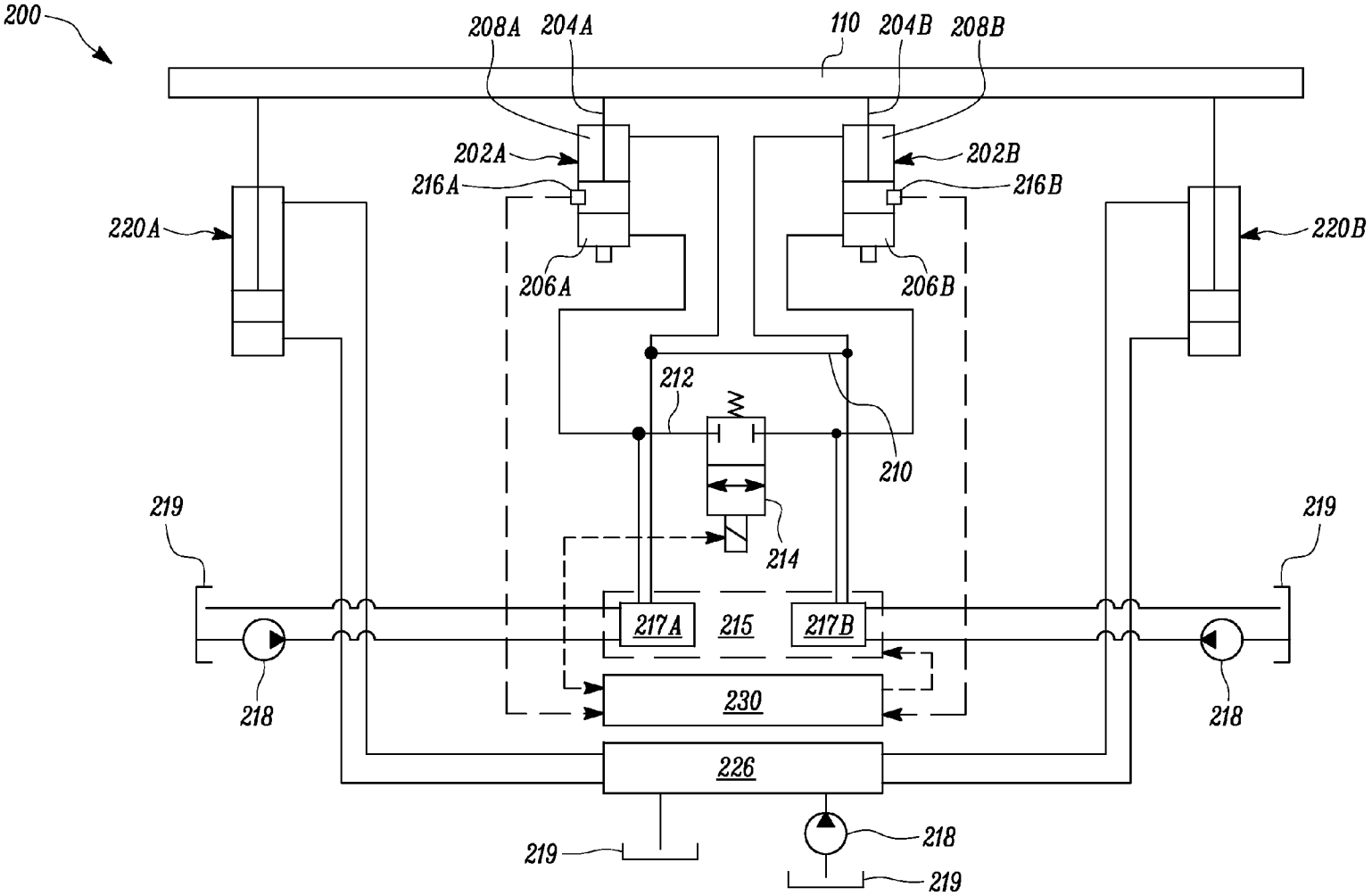
FIG. 3 is a circuit diagram of the control system, according to an embodiment of the current disclosure.

Referring to FIGS. 2 and 3, the machine 100 further includes a control system 200 for the work implement 110. The control system 200 includes a pair of lift cylinders 202A, 202B (also collectively referred to as "the lift cylinders 202") coupled to the frame 102 of the machine 100. The lift cylinders 202A, 202B may include rods 204A, 204B respectively, that are slidably received therein. The rods 204A, 204B may move back and forth in the corresponding lift cylinders 202A, 202B as is known by persons skilled in the art. The rod 204A may include piston (not shown) operable to divide the inside of the lift cylinder 202A in two chambers, namely, the cap end 206A and the rod end 208A. Similarly, the rod 204B may include piston (not shown)

operable to divide the inside of the lift cylinder 202B in two chambers, namely, the cap end 206B and the rod end 208B. In the illustrated embodiment, the lift cylinders 202A, 202B may be oriented such that an extending movement of the rods 204A, 204B inside the corresponding lift cylinders 202A, 202B extends the rod ends 208A, 208B.

Each of the lift cylinders 202 are coupled to the frame 102 adjacent to the cap ends 206A, 206B. In an example, the lift cylinders 202 may be coupled to the frame 102 using fasteners such as brackets. Each of the lift cylinders 202 are also operatively coupled to the work implement 110. In one example, the lift cylinders 202 may be coupled to the work implement 110 adjacent to the rod ends 208A, 208B. In another example, the rod ends 208A, 208B may be coupled to the corresponding push arms 114A, 114B of the machine 100.

In an embodiment, the lift cylinders 202 may be coupled to the frame 102 adjacent to the rod ends 208A, 208B. Accordingly, the lift cylinders 202 may be coupled to the work implement 110 or the push arms 114A, 114B adjacent to the cap end 206A, 206B.

The control system 200 also includes a first cross-over line 210 configured to fluidly communicate the rod ends 208A, 208B of the lift cylinders 202A, 202B with each other. The control system 200 further includes a second cross-over line 212 configured to fluidly communicate the cap ends 206A, 206B of each of the lift cylinders 202.

In an alternative embodiment, the first cross-over line 210 may be configured to fluidly communicate to one of the rod ends 208A, 208B and the cap ends 206A, 206B to each other. In such a case, the second cross-over line 212 may be configured to fluidly communicate to the other of the rod ends 208A, 208B and the cap ends 206A, 206B to each other.

The control system 200 may also include a lift valve unit 215 in fluid communication with the first cross-over line 210 and the second cross-over line 212. In the illustrated embodiment, the lift valve unit 215 includes a first valve assembly 217A and a second valve assembly 217B. The first valve assembly 217A may be configured to regulate a supply of hydraulic fluid to and from the lift cylinder 202A. The second valve assembly 217B may be configured to regulate a supply of hydraulic fluid to and from the lift cylinder 202B.

Each of the first and second valve assemblies 217A, 217B may be in fluid communication with a fluid source 218 and a fluid tank 219. The fluid source 218 is configured to be selectively fluidly connected to the cap ends 206A, 206B and the rod ends 208A, 208B of the corresponding lift cylinders 202A, 202B.

In an example, the first valve assembly 217A may include two valves (not shown). One of these valves may be fluidly communicated between the fluid source 218 and the cap end 206A to supply a pressurized fluid to the cap end 206A. Further, the other valve may be fluidly communicated between the cap end 206A and the fluid tank 219 to drain the fluid from the cap end 206A to the fluid tank 219. Similarly, the valves may also be fluidly communicated between the fluid source 218 and the rod end 208A; and between the fluid tank 219 and the rod end 208A. The valves may embody any suitable configurations such as, electrohydraulic valves known in the art.

As such, when the fluid source 218 is fluidly connected to the cap end 206A, generally, the fluid tank 219 is fluidly connected to the rod end 208A. Conversely, when the fluid source 218 is fluidly connected to the rod end 208A, generally, the fluid tank 219 is fluidly connected to the cap end 206A.

Similar to the first valve assembly 217A, the second valve assembly 217B may also include a pair of valves fluidly communicated with the fluid source 218 and the fluid tank 219. Accordingly, the valves may be fluidly communicated between the cap end 206B; the rod end 208B and the fluid source 218 and the fluid tank 219 as described above with reference to the first valve assembly 217A.

However, any other kinds of valve arrangements and configurations may be implemented in the first and second valve assemblies 217A, 217B to suit a specific requirement of an application.

The lift cylinders 202 are configured to raise or lower the work implement 110 with respect to the frame 102 of the machine 100. Moreover, a retracting movement or an extending movement of each of the lift cylinders 202A, 202B may raise or lower the work implement 110. In an example, the pressurized hydraulic fluid may flow into the cap end 206A, extending the rod 204A from the lift cylinder 202A thereby lowering the work implement 110. As the pressurized fluid flows into the cap end 206A from the fluid source 218, the fluid flows out of the rod end 208A to the fluid tank 219. In another example, the pressurized fluid may also flow into the rod end 208A, retracting the rod 204A into the lift cylinder 202A, and thereby raising the work implement 110. As the pressurized fluid flows into the rod end 208A, fluid flows out of the cap end 206A. Further, the lift cylinder 202B may operate similar to the lift cylinder 202A as described above to raise or lower the work implement 110.

In another embodiment, the lift cylinders 202 may be coupled to other suitable linkage systems such that retracting the rod 204A inside the lift cylinder 204A by supplying the pressurized hydraulic fluid into the rod end 208A may lower the work implement 110. As the pressurized fluid flows into the rod end 208A from the fluid source 218, the fluid flows out of the cap end 206A to the fluid tank 219. Similarly, in such a case, the pressurized fluid may flow into the cap end 206A, extending the rod 204A from the lift cylinder 202A, and thereby raising the work implement 110. As the pressurized fluid flows into the cap end 206A, fluid flows out of the rod end 208A. In such a case, the lift cylinder 202B may operate similar to the lift cylinder 202A as described above to raise or lower the work implement 110.

However, it may be contemplated to implement any other linkage systems to couple the lift cylinders 202 to the frame 102 and/or the work implement 110 based on a type of application.

The fluid source 218 may include any source of pressurized hydraulic fluid that would be known by an ordinary person skilled in the art. In an example, the fluid source 218 may include a fixed displacement pump (not shown), a variable displacement pump or others. The fluid tank 219 may include any reservoir for holding fluid that would be known by any person of ordinary skill in the art.

The lift valve unit 215 as illustrated, is exemplary in nature and non-limiting to this disclosure, and it may be envisioned to use other configurations for the lift valve unit 215 to implement the features of the present disclosure.

As shown, the control system 200 further includes a cross-over valve 214. The cross-over valve 214 may be disposed in one of the first and second cross-over lines 210, 212. In one example, the cross-over valve 214 is disposed in the second cross-over line 212 and configured to regulate a flow of the hydraulic fluid therethrough. In the illustrated embodiment, the cross-over valve 214 is a two position, normally open, electrically actuated valve. In an example, the cross-over valve 214 may be spring biased to a closed position. In another example, the cross-over valve 214 may be spring biased to an open position. Accordingly, the cross-over valve 214 may be configured to be operable in the open position and the closed position. As such, in the open position of the cross-over valve 214, the cap ends 206A, 206B of the lift cylinders 202A, 202B are in fluid communication with each other. Further, in the closed position of the cross-over valve 214, the fluid communication between the cap ends 206A, 206B of the lift cylinders 202A, 202B may be blocked. In another embodiment, the cross-over valve 214 may be a proportional valve. In such a case, the cross-over valve 214 may be partially opened and partially closed. In various other embodiments, the cross-over valve 214 may embody any valve known in the art that is configured to be electrically controlled to regulate a flow of the hydraulic fluid therethrough.

The control system 200 may also include a pair of lift cylinder sensors 216A, 216B (also collectively referred to as "the lift cylinder sensor/s 216") associated with each of the lift cylinders 202A, 202B. The lift cylinder sensors 216 may be configured to generate signals indicative of a displacement of the corresponding lift cylinders 202. Specifically, the signals are indicative of the displacement of the rods 204A, 204B within the corresponding lift cylinders 202A, 202B. A person of ordinary skill in the art will understand that operational velocities of each of the lift cylinders 202 may also be determined using the respective displacements. In an example, the lift cylinder sensors 216 may be position sensors. In other embodiments, the lift cylinder sensors 216 may embody other type of sensors known in the art configured to determine the displacements and/or the operational velocities of the associated lift cylinders 202.

The control system 200 may include a pair of tilt cylinders 220A, 220B (also collectively referred to as "the tilt cylinders 220") operatively coupled to the work implement 110. Each of the tilt cylinders 220A, 220B includes a first end 222A, 222B and a second end 224A, 224B respectively. In the illustrated embodiment, the first ends 222A, 222B may be pivotally coupled to the work implement 110. Further, the second ends 224A, 224B may be pivotally coupled to the corresponding push arms 114 of the machine 100. In an example, the coupling of the first ends 222A, 222B, and the second ends 224A, 224B with the work implement 110 and the push arms 114 respectively may be accomplished using fasteners such as, clevis pin, pivot pins and the like.

In the illustrated embodiment, the first ends 222A, 222B are rod ends while the second ends 224A, 224B may be cap ends of the tilt cylinders 220A, 220B. Alternatively, the first ends 222A, 222B may be the cap ends while the second ends 224A, 224B may be the rod ends of the tilt cylinders 220A, 220B. The tilt cylinders 220A, 220B may be configured to rotate the work implement 110 about the longitudinal axis AA' and the transverse axis BB' to provide a tilting movement to the work implement 110.

Referring to FIG. 3, the control system 200 may also include a tilt valve unit 226 configured to regulate a supply of hydraulic fluid to and from each of the tilt cylinders 220A, 220B. Similar to the lift valve unit 215, the tilt valve unit 226 may include a pair of first and second valve assemblies (not shown). As shown, the tilt valve unit 226 may be in fluid communication with the fluid source 218 and the fluid tank 219. The fluid source 218 may be configured to be selectively fluidly connected to the first ends 222A, 222B and the second ends 224A, 224B of the corresponding tilt cylinders 220A, 220B. As such, when the fluid source 218 is fluidly connected to the first ends 222A, 222B generally, the fluid tank 219 is fluidly connected to the second ends 224A, 224B respectively. Conversely, when the fluid source 218 is fluidly connected to the second ends 224A, 224B generally, the fluid tank 219 is fluidly connected to the first ends 222A, 222B respectively.

Further, the tilt cylinders 220A, 220B may be configured such that, an extension or a retracting movement of the first ends 222A, 222B or the second ends 224A, 224B relative to the other may cause the tilting movement to the work implement 110. In an example, the pressurized hydraulic fluid may flow into the first end 222A of the tilt cylinder 220A and the second end 224B of the tilt cylinder 220B thereby extending a rod from the tilt cylinder 220A and retracting a rod from the tilt cylinder 220B. As the pressurized fluid flows into the first end 222A and the second end 224B from the fluid source 218, the fluid flows out of the second end 224A and the first end 222B respectively to the fluid tank 219. With such implementation, the work implement 110 may be tilted about the longitudinal axis AA'. In another example, each of the tilt cylinders 220A, 220B may be equally actuated i.e., extended or retracted to provide the tilting movement to the work implement 110 about the transverse axis BB'.

In one embodiment, the tilt cylinders 220A, 220B and/or the tilt valve unit 226 may be configured to be controlled based on a user input. Additionally or optionally, the tilt cylinders 220A, 220B and/or the tilt valve unit 226 may also be configured to be controlled automatically based on a type of the operation being performed, or a profile of the surface on which the operation is performed or other parameters.

Although, the lift valve unit 215 and the tilt valve unit 226 are shown to be in fluid communication with the same fluid source 218 and the fluid tank 219, it may be contemplated to implement a different fluid source and/or a different fluid tank for the lift valve unit 215 and the tilt valve unit 226.

The control system 200 further includes a controller 230. The controller 230 may be an electronic controller that operates in a logical fashion to perform operations, execute control algorithms, store and retrieve data and other desired operations. The controller 230 may include or access memory, secondary storage devices, processors, and any other components for running an application. The memory and secondary storage devices may be in the form of read-only memory (ROM) or random access memory (RAM) or integrated circuitry that is accessible by the controller 230. Various other circuits may be associated with the controller 230 such as power supply circuitry, signal conditioning circuitry, driver circuitry, and other types of circuitry.

The controller 230 may be a single controller or may include more than one controller disposed to control various functions and/or features of the machine 100. The term "controller" is meant to be used in its broadest sense to include one or more controllers and/or microprocessors that may be associated with the machine 100 and that may cooperate in controlling various functions and operations of the machine 100. The functionality of the controller 230 may be implemented in hardware and/or software without regard to the functionality employed. The controller 230 may also use one or more data maps relating to the operating conditions of the machine 100 that may be stored in the memory of the controller 230.

The controller 230 may be configured to determine an occurrence of the dump cycle for the work implement 110 based on any methods known in the art. In an example, the controller 230 may detect the dump cycle based on the commands from the operator provided via the input device in the cab 112. These commands may be transmitted via sensors and/or communication links to the controller 230. In another example, the controller 230 may detect the dump cycle based on a position of the lift cylinders 202A, 202B and/or the tilt cylinders 220A, 220B. Moreover, these methods of determining or detecting the dump cycle for the machine 100 are well known in the art and a detailed description is not included herein.

The controller 230 is communicably coupled to the cross-over valve 214. The controller 230 is configured to at least partially close the cross-over valve 214 during the dump cycle of the work implement 110. In one embodiment, the cross-over valve 214 may be moved to the full closed position. In other embodiments, the cross-over valve 214 may be partially closed.

The controller 230 may also be communicably coupled to the lift valve unit 215 and the pair of lift cylinder sensors 216. The controller 230 may receive signals indicative of displacements of each of the lift cylinders 202A, 202B via the corresponding lift cylinder sensors 216A, 216B. In one embodiment, the controller 230 may be configured to regulate the lift valve unit 215 in order to at least reduce a difference between the displacements of the lift cylinders 202 during the dump cycle. In another embodiment, the controller 230 may be configured to regulate the lift valve unit 215 in order to maintain the difference between the displacements of the lift cylinders 202 during the dump cycle. In yet another embodiment, the controller 230 may be configured to regulate the lift valve unit 215 to reduce the difference to a predetermined value and further maintain the difference at the predetermined value. In yet another embodiment, the controller 230 may be configured to regulate the lift valve unit 215 to allow a limited increase in the difference in the displacements of the lift cylinders 202 during the dump cycle.

Additionally or optionally, the controller 230 may determine operational velocities of each of the lift cylinders 202 based on the displacements related signals received via the lift cylinder sensors 216. Accordingly, the controller 230 may regulate the lift valve unit 215 to equalize or limit the difference in the operational velocities and/or the displacements of each of the lift cylinders 202.

During the dump cycle, the work implement 110 may be raised to a suitable height via the lift cylinders 202 and also tilted via the tilt cylinders 220 to perform the dumping operation. Moreover, to raise the work implement 110 as discussed above, the pressurized fluid may be supplied to the rod ends 208A, 208B and consequently the rods 204A, 204B are retracted into the corresponding lift cylinders 202A, 202B. Further, each of the tilt cylinders 220 may operate accordingly to rotate the work implement 110 about the transverse axis BB' during the dumping operation of the dump cycle. However, during the dumping operation, one of the rods 202A, 202B may be in a retracted positon while the other rod 202A, 202B may be in an extended position to facilitate the rotation of the work implement 110. The controller 230 may be configured to regulate the lift valve unit 215 so as to provide resistance to any further retraction or further extension of the corresponding rods 202A, 202B beyond the desired position and/or equalize the operational velocities of each of the lift cylinders 202.

Accordingly, the controller 230 may identify an overrunning lift cylinder 202 based on the displacements and/or the operational velocities. In one embodiment, the controller 230 may be configured to determine the overrunning lift cylinder 202 as the lift cylinder having a greater operational velocity or greater displacements among the pair of lift cylinders 202A, 202B.

For example, the controller 230 may determine the overrunning lift cylinder (e.g., 202A) as the lift cylinder in the retracted position during the dumping operation based on the displacements and/or the operational velocities. In such a case, the controller 230 may partially close the fluid communication between the fluid tank 219 and the cap end 206A of the overrunning lift cylinder 202A. Further, the controller 230 may control a supply of the pressurized hydraulic fluid to the rod end 208A of the overrunning lift cylinder 202A to reduce the corresponding displacement.

In one embodiment, the controller 230 may control the supply to reduce the difference between the displacements of each of the lift cylinders 202A, 202B. Additionally, the controller 230 may suitably control the lift valve unit 215 corresponding to the other lift cylinder 202B so as to reduce the difference between the displacements. Moreover, the controller 230 may regulate the supply until the operational velocities and/or displacements of each of the lift cylinders 202A, 202B are substantially equal to each other. In another embodiment, the controller 230 may control the supply so as to maintain the difference between the displacements determined for the lift cylinders 202A, 202B. Accordingly, the controller 230 may control the lift valve unit 215 to maintain the difference.

Similarly, the controller 230 may be configured to regulate the supply of hydraulic fluid via the lift valve unit 215 to any of the lift cylinders 202A, 202B so as to maintain, reduce, or limit the difference between the displacements and/or operational velocities of the lift cylinders 202A, 202B.

INDUSTRIAL APPLICABILITY

Figure 4:
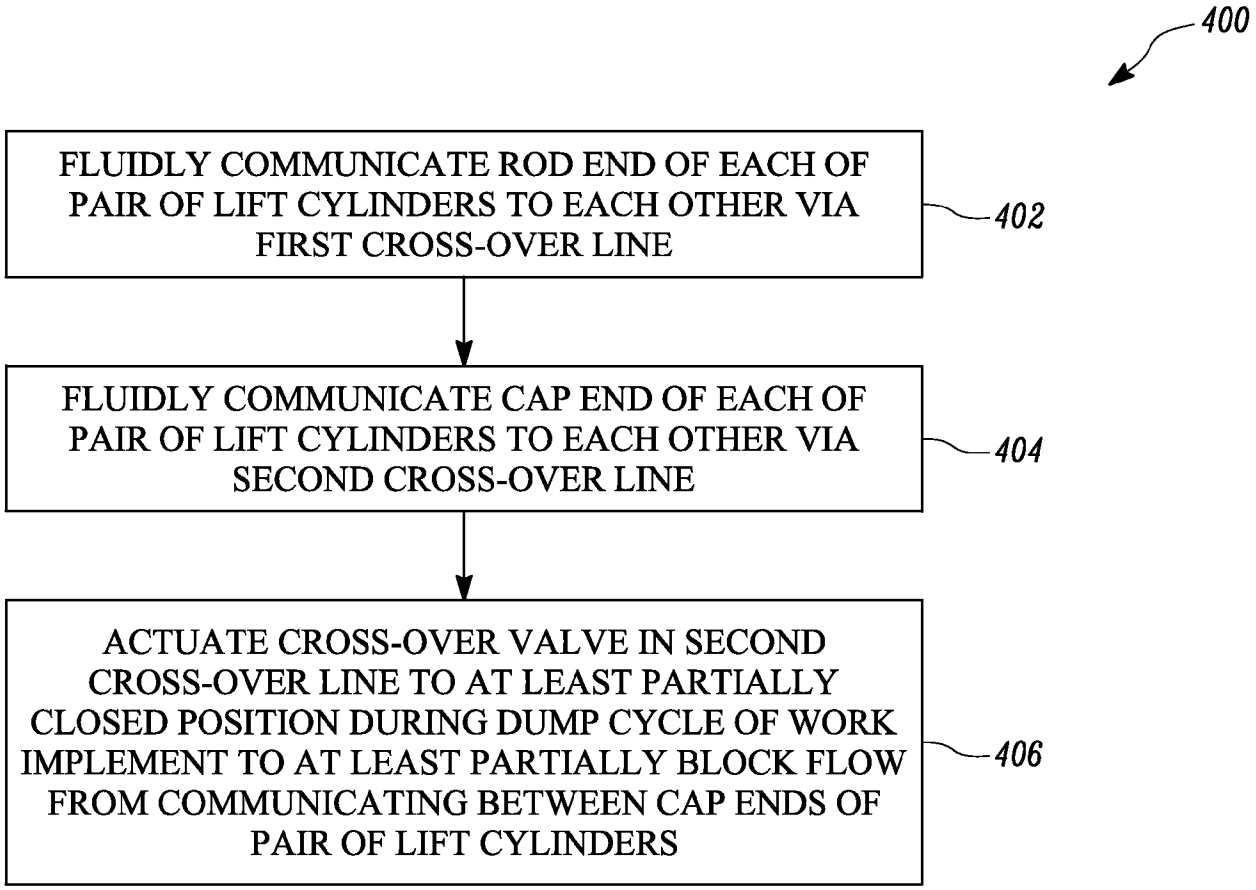
FIG. 4 is a flowchart of a method of controlling the work implement, according to an embodiment of the current disclosure.

Referring to FIG. 4, a method 400 of controlling a work implement of a machine having a pair of lift cylinders is illustrated. The method 400 will be explained in conjunction with the machine 100 of FIG. 1. However, it may be envisioned to implement the method 400 in any other machine having the pair of lift cylinders 202A, 202B that are configured to raise or lower the work implement 110 with respect to the frame 102 of the machine 100.

The work implement may be configured to perform digging operation to dig the material from the work site and move to a dump site while holding the material, and finally dumping the material at the dump site. In an embodiment, the dump cycle for the work implement 110 may be defined as a cycle in which the work implement 110 holds and dumps the material. Accordingly, during the dump cycle, the work implement 110 may moved along the longitudinal axis AA' and/or raised to reach the dumping location and also rotated about the transverse axis BB' of the frame 102 for dumping the material.

The machine 100 includes the lift cylinders 202A, 202B are operatively coupled to the work implement 110 and are configured to raise or lower the work implement 110 with respect to the frame 102 of the machine. Further, each of the lift cylinders 202A, 202B includes a rod end 208A, 208B and the cap end 206A, 206B. The machine may also include the tilt cylinders 220A, 220B configured to rotate the work implement 110 about the transverse axis BB'.

At step 402, the method 400 includes fluidly communicating the rod ends 208A, 208B of the lift cylinders 202A, 202B with each other via the first cross-over line 210. At step 404, the method 400 includes fluidly communicating the cap ends 206A, 206B of the lift cylinders 202A, 202B with each other via the second cross-over line 212. The second cross-over line includes a cross-over valve movable between an open position and a closed position. In an example, the cross-over valve 214 may be a two position, electrically actuated valve that may be may be spring biased to either the closed position or the open position. In various other examples, the cross-over valve 214 may be any type of valve known in the art that is configured to be electrically controlled to regulate a flow of the hydraulic fluid therethrough.

At step 406, the method 400 includes actuating the cross-over valve 214 to at least partially closed position during the dump cycle of the work implement 110 to at least partially block flow from communicating between the cap ends 206A, 206B of the lift cylinders 202A, 202B.

Further, the method 400 may also include determining the displacements of each of the pair of lift cylinders 202. In an example, the displacements may be determined via the lift cylinder sensors 216. In one embodiment, the method 400 may include regulating a flow of hydraulic fluid to and from the pair of lift cylinders 202 to at least reduce a difference between the displacements of the pair of the lift cylinders 202 during the dump cycle. Moreover, the controller 230 may regulate the supply until the displacements of each of the lift cylinders 202A, 202B are substantially equal to each other. In another embodiment, the method 400 may include regulating a flow of the hydraulic fluid to and from the pair of lift cylinders 202 to maintain the difference between the displacements of the pair of the lift cylinders 202 during the dump cycle. In yet another embodiment, the method 400 may include regulating a flow of the hydraulic fluid to and from the pair of lift cylinders 202 to allow a limited increase in the difference.

In an embodiment, the flow of the hydraulic fluid to and from the pair of lift cylinders 202A, 202B may be regulated via the lift valve unit 215. In an example, the overrunning lift cylinder 202 may be identified based on the displacements and a supply of the pressurized fluid to either the cap ends 206A, 206B or the rod ends 208A, 208B may be at least partially blocked.

With an implementation of the control system 200 and/or the method 400 in any machine, an undesirable tilt during the dump cycle may be reduced. Further, the controller 230 may also configured to regulate a flow of fluid to the lift cylinders 202 during the dump cycle. As such, at least one of the operational velocity and/or displacement of the lift cylinder 202 with a greater load among the pair of lift cylinders 202 may be reduced to an optimum operational velocity and/or displacement. Moreover, such an implementation may also avoid overrunning of the lift cylinders 202.

Further, the control system 200 of the present disclosure is configured to utilize lift cylinder sensors 216 that may be commonly implemented in the existing machines. The lift cylinder sensors 216 are configured to provide displacements of each of the lift cylinders 202. Since a tilt in the work implement 110 may cause a change to the relative displacements of the lift cylinders 202, the tilt can thus be monitored through the lift cylinder sensors 216. With implementation of the present control system 200 or the method 400, an overrunning lift cylinder 202 may be identified. During the overrunning lift cylinder event, the supply of the fluid to the lift cylinders 202 may be accordingly regulated until the operational velocities of each of the lift cylinders 202 are substantially equal to each other.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A control system for a work implement of a machine having a frame, the control system comprising:

a pair of lift cylinders operatively coupled to the work implement and configured to raise or lower the work implement with respect to the frame of the machine, each of the lift cylinders having a rod end and a cap end;

a first cross-over line configured to fluidly communicate the rod end of each of the pair of lift cylinders to each other;

a second cross-over line configured to fluidly communicate the cap end of each of the pair of lift cylinders to each other;

a cross-over valve disposed in one of the first and second cross-over lines and configured to regulate a flow of hydraulic fluid therethrough; and a controller communicably coupled to the cross-over valve, the controller configured to identify a displacement difference between the pair of lift cylinders and operate the cross-over valve from a first position with a first opening cross-section to a second position with a second opening cross-section smaller than the first opening cross-section to one of maintain the displacement difference without first reducing the displacement difference and provide limited increase of the displacement difference, during a dump cycle of the work implement.

2. The control system of claim 1 further comprising a lift valve unit having a first pair of valves in fluid communication with the first cross-over line to regulate a first supply of hydraulic fluid to and from the cap end of each of the pair of lift cylinders, and a second pair of valves in fluid communication with the second cross-over line to regulate a second supply of hydraulic fluid to and from the rod end of each of the pair of lift cylinders.

3. The control system of claim 2 further comprising a pair of lift cylinder sensors associated with the pair of lift cylinders, each of the pair of lift cylinder sensors configured to generate signals indicative of a displacement of a corresponding lift cylinder of the pair of lift cylinders.

4. The control system of claim 3, wherein the controller is communicably coupled to the lift valve unit and the pair of lift cylinder sensors, wherein the controller is further configured to regulate the lift valve unit based on the signals received from the pair of lift cylinders during the dump cycle of the work implement, and wherein the first cross-over line and the second cross-over line are fluidly insulated from each other.

5. The control system of claim 3, wherein the controller is communicably coupled to the lift valve unit and the pair of lift cylinder sensors, and wherein the controller is further configured to regulate the lift valve unit based on the signals received from the pair of lift cylinders in order to one of maintain the displacement difference without first reducing the displacement difference and provide limited increase of the displacement difference during the dump cycle of the work implement.

6. The control system of claim 1 further comprising a pair of tilt cylinders operatively coupled to the work implement and configured to rotate the work implement about a longitudinal axis and a transverse axis of the frame of the machine.

7. The control system of claim 6 further comprising a tilt valve unit operatively configured to regulate a supply of hydraulic fluid to and from each of the pair of tilt cylinders.

8. The control system of claim 7, wherein during the dump cycle of the work implement, the controller is configured to regulate the tilt valve unit to rotate work implement about the transverse axis of the frame of the machine.

9. A method of controlling a work implement of a machine having a pair of lift cylinders operatively coupled to the work implement and configured to raise or lower the work implement with respect to a frame of the machine, the method comprising:

fluidly communicating a rod end of each of the pair of lift cylinders to each other via a first cross-over line;

fluidly communicating a cap end of each of the pair of lift cylinders to each other via a second cross-over line, wherein the second cross-over line includes a cross-over valve movable between a first position with a first opening cross-section and a second position with a second opening cross-section smaller than the first opening cross-section;

identifying a displacement difference between the pair of lift cylinders during a dump cycle of the work implement; and actuating the cross-over valve from the first position to the second position to one of maintain the displacement difference without first reducing the displacement difference and provide limited increase of the displacement difference during the dump cycle of the work implement.

10. The method of claim 9, further comprising:

determining the displacement difference based on a displacement of each of the pair of lift cylinders; and regulating, via a lift valve unit, a flow of hydraulic fluid to and from the pair of lift cylinders during the dump cycle of the work implement.

11. The method of claim 9, further comprising:

determining the displacement difference based on a displacement of each of the pair of lift cylinders; and regulating, via a lift valve unit, a flow of hydraulic fluid to and from the pair of lift cylinders to one of maintain the displacement difference without first reducing the displacement difference and provide limited increase of the displacement difference during the dump cycle of the work implement, wherein the first cross-over line and the second cross-over line are fluidly insulated from each other.

12. The method of claim 9, further comprising regulating, via a tilt valve unit, a supply of hydraulic fluid to and from a pair of lift cylinders to rotate the work implement about a transverse axis of the fame of the machine during the dump cycle of the work implement.

13. A machine comprising:

a frame defining a longitudinal axis and a transverse axis substantially perpendicular to the longitudinal axis;

a work implement movably coupled to the frame;

a pair of lift cylinders coupled to the frame and operatively coupled to the work implement, the pair of lift cylinders configured to raise or lower the work implement with respect to the frame of the machine, each of the pair of lift cylinders having a rod end and a cap end;

a pair of tilt cylinders operatively coupled to the work implement and configured to rotate the work implement about the longitudinal axis and the transverse axis of the frame of the machine;

a first cross-over line configured to fluidly communicate to one of the rod end and the cap end of each of the pair of lift cylinders to each other;

a second cross-over line configured to fluidly communicate to other of the rod end and the cap end of each of the pair of lift cylinders to each other;

a cross-over valve disposed in the second cross-over line and configured to regulate a flow of hydraulic fluid therethrough; and a controller communicably coupled to the cross-over valve, the controller configured to identify a displacement difference between the pair of lift cylinders and operate the cross-over valve from a first position with a first opening cross-section to a second position with a second opening cross-section smaller than the first opening cross-section to one of maintain the displacement difference without first reducing the displacement difference and provide limited increase of the displacement difference, during a dump cycle of the work implement.

14. The machine of claim 13 further comprising a lift valve unit having a first pair of valves in fluid communication with the first cross-over line to regulate a first supply of hydraulic fluid to and from the cap end of each of the pair of lift cylinders, and a second pair of valves in fluid communication with the second cross-over line to regulate a second supply of hydraulic fluid to and from the rod end of each of the pair of lift cylinders.

15. The machine of claim 14 further comprising a pair of lift cylinder sensors associated with the pair of lift cylinders, each of the pair of lift cylinder sensors configured to generate signals indicative of a displacement of a corresponding lift cylinder of the pair of lift cylinders.

16. The machine of claim 15, wherein the controller is communicably coupled to the lift valve unit and the pair of lift cylinder sensors, wherein the controller is further configured to regulate the lift valve unit based on the signals received from the pair of lift cylinders during the dump cycle of the work implement, and wherein the first cross-over line and the second cross-over line are fluidly insulated from each other.

17. The machine of claim 15, wherein the controller is communicably coupled to the lift valve unit and the pair of lift cylinder sensors, and wherein the controller is further configured to regulate the lift valve unit based on the signals received from the pair of lift cylinders in order to one of maintain the displacement difference without first reducing the displacement difference and provide limited increase of the displacement difference during the dump cycle of the work implement.

18. The machine of claim 17 further comprising a fluid tank configured to store hydraulic fluid therein and disposed in fluid communication with the lift valve unit, wherein the controller is further configured to regulate the lift valve unit to at least partially close fluid communication between the fluid tank and at least one of the pair of lift cylinders during the dump cycle of the work implement.

19. The machine of claim 13 further comprising a tilt valve unit operatively configured to regulate a supply of hydraulic fluid to and from each of the pair of tilt cylinders.

20. The machine of claim 19, wherein during the dump cycle of the work implement, the controller is configured to regulate the tilt valve unit to rotate work implement about the transverse axis of the frame of the machine.

* * * * *